US008159358B2

(12) United States Patent
van Schie et al.

(10) Patent No.: US 8,159,358 B2
(45) Date of Patent: Apr. 17, 2012

(54) APPARATUS AND METHOD FOR STORAGE TANK HATCH MONITORING IN AN INVENTORY MANAGEMENT SYSTEM

(75) Inventors: Adrianus Leonardus David van Schie, Zuid Holland (NL); Jan Leendert Stolk, Zuid Holland (NL)

(73) Assignee: Enraf B.V., Delft (NL)

( * ) Notice: Subject to any disclaimer, the term of this patent is extended or adjusted under 35 U.S.C. 154(b) by 519 days.

(21) Appl. No.: 12/118,930

(22) Filed: May 12, 2008

(65) Prior Publication Data

US 2009/0277374 A1 Nov. 12, 2009

(51) Int. Cl.

| | |
|---|---|
| ***G08B 21/00*** | (2006.01) |
| *G01F 23/00* | (2006.01) |
| *B01D 21/26* | (2006.01) |
| *B67D 1/00* | (2006.01) |
| *G01M 3/04* | (2006.01) |
| *G05B 13/02* | (2006.01) |

(52) U.S. Cl. ..... 340/618; 340/603; 116/109; 210/512.1; 222/64; 73/49.2; 700/29

(58) Field of Classification Search ..... 340/618, 340/630; 116/109; 700/29; 210/512.1
See application file for complete search history.

(56) References Cited

U.S. PATENT DOCUMENTS

| | | | | |
|---|---|---|---|---|
| 4,259,975 | A * | 4/1981 | Kinsey et al. | 137/1 |
| 5,406,842 | A | 4/1995 | Locke | |
| 5,442,359 | A | 8/1995 | Rubin | |
| 5,774,089 | A | 6/1998 | Bamler et al. | |
| 6,629,458 | B1 | 10/2003 | Westerling et al. | |
| 2002/0038156 | A1 * | 3/2002 | Eryurek et al. | 700/29 |
| 2003/0028336 | A1 | 2/2003 | Masar et al. | |
| 2003/0167839 | A1 | 9/2003 | Burger et al. | |
| 2004/0098218 | A1 | 5/2004 | Ito et al. | |
| 2004/0196177 | A1 | 10/2004 | Billington et al. | |
| 2005/0190098 | A1 | 9/2005 | Bridgelall et al. | |
| 2006/0032863 | A1 * | 2/2006 | Miller et al. | 222/64 |
| 2006/0230826 | A1 * | 10/2006 | Nakamura et al. | 73/291 |

(Continued)

FOREIGN PATENT DOCUMENTS

| | | | |
|---|---|---|---|
| DE | 100 40 180 | A1 | 4/2002 |
| JP | 60183526 | | 9/1985 |
| WO | WO 2004/053521 | A1 | 6/2004 |

(Continued)

OTHER PUBLICATIONS

Enraf, "Storage Tank Measurement, Entis Pro Inventory Systems", 8 pages.

(Continued)

*Primary Examiner* — George Bugg
*Assistant Examiner* — Jack Wang

(57) ABSTRACT

A method includes receiving information associated with a level of material in a tank, where the tank has a hatch. The method also includes determining whether the level of material in the tank experiences a specified variation within a critical zone associated with the hatch. The specified variation is indicative of the hatch being open while the tank is being filled. In addition, the method includes generating an alarm when the level of material in the tank experiences the specified variation. Determining whether the level of material in the tank experiences the specified variation could be based on an entrance level speed of the material, which identifies a rate at which the level of material in the tank is increasing when the material level crosses a lower bound of the critical zone. Also, no alarms could be generated when the level of material in the tank is outside the critical zone.

21 Claims, 7 Drawing Sheets

U.S. PATENT DOCUMENTS

2007/0027594 A1 2/2007 Mcnevich et al.

FOREIGN PATENT DOCUMENTS

WO WO 2007/053007 A1 5/2007
WO WO 2007/111498 A3 10/2007

OTHER PUBLICATIONS

Supplementary European Search Report dated Sep. 19, 2011 in connection with European Patent Application No. 09 74 7146.

* cited by examiner

600

Event Viewer

Dynamic View:

Events

| Event | Date/Time | Station | UserName | TaskName | EventType | Source | Description |
|---|---|---|---|---|---|---|---|
| 2130 | 10/4/2008 4:37:35 PM | OTNLAMENR | en1275 | MHM | State change | 1007_Hatch | Hatch state changed from unknown to closed at product level (2.280m). |
| 2131 | 10/4/2008 4:38:21 PM | OTNLAMENR | en1275 | MHM | Shutdown | Maintenance | Application shutdown. |
| 2132 | 10/4/2008 4:39:10 PM | OTNLAMENR | en1275 | MHM | Start | MHM | Application start. |
| 2133 | 10/4/2008 4:39:32 PM | OTNLAMENR | en1275 | MHM | State change | 1001 | Hatch state changed from unknown to dry at product level (0.360m). |
| 2134 | 10/4/2008 4:39:32 PM | OTNLAMENR | en1275 | MHM | State change | 1002_A | Hatch state changed from unknown to closed at product level (2.140m). |
| 2135 | 10/4/2008 4:39:32 PM | OTNLAMENR | en1275 | MHM | State change | 1002_B | Hatch state changed from unknown to closed at product level (2.140m). |
| 2136 | 10/4/2008 4:39:32 PM | OTNLAMENR | en1275 | MHM | State change | 1003_Hatch | Hatch state changed from unknown to closed at product level (2.200m). |
| 2137 | 10/4/2008 4:39:32 PM | OTNLAMENR | en1275 | MHM | State change | 1004_Hatch | Hatch state changed from unknown to closed at product level (2.220m). |
| 2138 | 10/4/2008 4:39:32 PM | OTNLAMENR | en1275 | MHM | State change | 1005_Hatch | Hatch state changed from unknown to closed at product level (2.240m). |
| 2139 | 10/4/2008 4:39:32 PM | OTNLAMENR | en1275 | MHM | State change | 1006_Hatch | Hatch state changed from unknown to closed at product level (2.413m). |
| 2140 | 10/4/2008 4:39:32 PM | OTNLAMENR | en1275 | MHM | State change | 1007_Hatch | Hatch state changed from unknown to closed at product level (2.280m). |

602

10/4/2007 4:43 PM

FIG. 6

APPARATUS AND METHOD FOR STORAGE TANK HATCH MONITORING IN AN INVENTORY MANAGEMENT SYSTEM

TECHNICAL FIELD

This disclosure relates generally to inventory management systems and more specifically to an apparatus and method for storage tank hatch monitoring in an inventory management system.

BACKGROUND

Processing facilities and other facilities routinely include tanks for storing liquid materials and other materials. For example, oil storage tanks or tanks storing other materials are routinely used in tank farm facilities and other storage facilities. The tanks routinely include hatches providing access to the interior of the tanks. This may allow, for example, maintenance personnel to enter the tanks and perform inspections or other maintenance operations. Some tanks may have their hatches opened only once per year, while other tanks may have their hatches opened more frequently or less frequently.

SUMMARY

This disclosure provides an apparatus and method for storage tank hatch monitoring in an inventory management system.

In a first embodiment, a method includes receiving information associated with a level of material in a tank, where the tank has a hatch. The method also includes determining whether the level of material in the tank experiences a specified variation within a critical zone associated with the hatch. The specified variation is indicative of the hatch being open while the tank is being filled. In addition, the method includes generating an alarm when the level of material in the tank experiences the specified variation.

In particular embodiments, determining whether the level of material in the tank experiences the specified variation includes measuring an entrance level speed of the material. The entrance level speed represents a rate at which the level of material in the tank is increasing when the material level crosses a lower bound of the critical zone. It also includes determining a reference level speed using the entrance level speed and determining whether a measured level speed of the material in the tank falls below the reference level speed when the material level is in the critical zone. It can further include using a minimum level speed of the material as the reference level speed when the entrance level speed cannot be determined.

In other particular embodiments, the method also includes determining a resume level speed using the entrance level speed and inactivating the alarm when the measured level speed of the material in the tank rises above the resume level speed. The reference level speed could represent a first percentage of the entrance level speed, and the resume level speed could represent a second larger percentage of the entrance level speed.

In yet other particular embodiments, the method further includes not generating the alarm when the level of material in the tank is outside of the critical zone. In still other particular embodiments, the critical zone is defined by two offset values associated with a bottom edge of the hatch.

In additional particular embodiments, receiving the information includes receiving level measurement data from a sensor. Also, the level measurement data could be received during a sequence of data update cycles. In addition, generating the alarm may include generating the alarm if the specified variation is maintained over multiple consecutive data update cycles.

In a second embodiment, an apparatus includes an interface configured to receive information associated with a level of material in a tank, where the tank has a hatch. The apparatus also includes a processor configured to determine whether the level of material in the tank experiences a specified variation within a critical zone associated with the hatch. The specified variation is indicative of the hatch being open while the tank is being filled. The processor is also configured to output an alarm when the level of material in the tank experiences the specified variation.

In a third embodiment, a system includes a sensor configured to measure a level of material in a tank, where the tank has a hatch. The system also includes a monitor configured to receive from the sensor measurement data associated with the level of material in the tank. The monitor is also configured to determine whether the level of material in the tank experiences a specified variation within a critical zone associated with the hatch. The specified variation is indicative of the hatch being open while the tank is being filled. The monitor is further configured to generate an alarm when the level of material in the tank experiences the specified variation.

In a fourth embodiment, a computer program is embodied on a computer readable medium. The computer program includes computer readable program code for determining whether a level of material in a tank experiences a specified variation within a critical zone associated with a hatch of the tank. The specified variation is indicative of the hatch being open while the tank is being filled. The computer program also includes computer readable program code for initiating an alarm when the level of material in the tank experiences the specified variation.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which:

FIGS. 3A through 6 illustrate an example user interface for monitoring a tank hatch in an inventory management system according to this disclosure.

DETAILED DESCRIPTION

FIGS. 1 through 7, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figure 1:
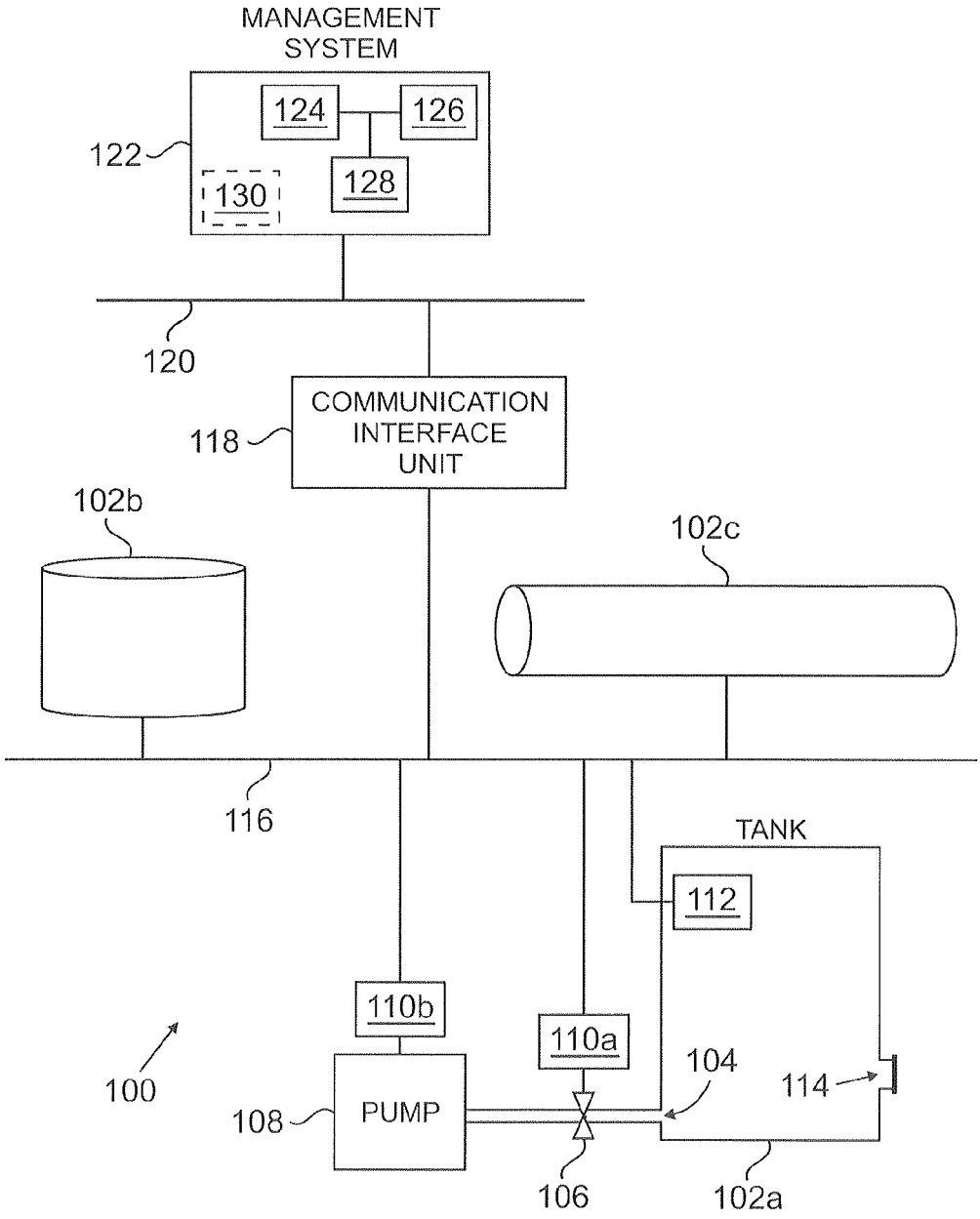
FIG. 1 illustrates an example inventory management system according to this disclosure.

FIG. 1 illustrates an example inventory management system 100 according to this disclosure. The embodiment of the inventory management system 100 shown in FIG. 1 is for illustration only. Other embodiments of the inventory management system 100 may be used without departing from the scope of this disclosure.

In this example embodiment, the inventory management system 100 includes one or more tanks 102*a*-102*c*. Each tank 102*a*-102*c* generally represents any suitable structure for receiving and storing at least one liquid or other material. The tanks 102*a*-102*c* could, for example, represent oil storage tanks or tanks for storing other liquid or other material(s). Also, each of the tanks 102*a*-102*c* could have any suitable shape and size, and different types of tanks could be used.

Each tank 102*a*-102*c* typically includes at least one port 104 through which material can enter or exit the tank. In this example, at least one valve 106 controls the flow of material into or out of the tank 102*a*. Also, a pump 108 is used to pump material into or out of the tank 102*a* through the valve 106. The valve 106 is associated with a valve actuator 110*a*, which can open and close the valve 106 to adjust the flow of material into or out of the tank 102*a*. Similarly, the pump 108 is associated with a pump actuator 110*b*, which can control the operation of the pump 108 to adjust the flow of material into or out of the tank 102*a*. The level of material in a tank can be measured by a level sensor 112, which can be located within or outside of the tank.

The valve 106 includes any suitable structure for controlling a flow of material. The valve actuator 110*a* includes any suitable structure for opening and closing at least one valve. The pump 108 includes any suitable structure for moving material. The pump actuator 110*b* includes any suitable structure for controlling the operation of at least one pump. The level sensor 112 includes any suitable gauge or other structure for measuring the level of material in a tank. For example, the level sensor 112 could reflect some form of radiation off the material in a tank, float on top of the material in the tank, or measure pressure of the material within the tank.

Each tank 102*a*-102*b* in this example may include at least one hatch 114, such as a maintenance hatch. The hatch 114 could, for example, represent a door or other opening that can be opened to provide access to the interior of the tank 102*a*-102*c*. The hatch 114 could then be closed and sealed to prevent material from leaking or otherwise escaping the tank 102*a*-102*c* through the hatch 114.

Maintenance or other personnel may sometimes forget to close the hatch 114 of a tank 102*a*-102*c* after the hatch 114 is opened. If material begins entering the tank 102*a*-102*c* when its hatch 114 is opened, this can result in loss of material through the hatch 114, as well as an associated monetary loss and environmental damage. Depending on the material, this could also result in higher insurance fees or even the loss or withdrawal of an operational license. While it is possible to physically wire a contact sensor to a hatch 114, this could require physical wires to be run to all hatches of all tanks in a facility, which can be quite expensive. In accordance with this disclosure, the inventory management system 100 implements a tool that allows the system 100 to automatically determine if and when a hatch 114 in a tank 102*a*-102*c* is opened and material is spilling from the tank 102*a*-102*c*. The tool can then take corrective action, such as by triggering an alarm to warn appropriate personnel about the open hatch.

In this example, at least one network 116 is coupled to the actuators 110*a*-110*b* and sensors 112. The network 116 facilitates interaction with the actuators 110*a*-110*b* and sensors 112. For example, the network 116 could transport measurement data from the sensors 112 and provide control signals to the actuators 110*a*-110*b*. The network 116 could represent any suitable network or combination of networks. As particular examples, the network 116 could represent an electrical signal network (such as a HART or FOUNDATION FIELDBUS network), a pneumatic control signal network, or any other or additional type(s) of network(s).

A communication interface unit 118 is coupled to the network 116 and to a network 120. The network 120 represents any suitable network for communicating with the communication interface unit 118, such as an Ethernet network. The communication interface unit 118 facilitates communication between different types of networks. For example, the communication interface unit 118 could receive Ethernet-formatted data over the network 120 and convert the data into appropriate electrical signals for communication over a FOUNDATION FIELDBUS network (network 116). The communication interface unit 118 could support communications between any other or additional types of networks. The communication interface unit 118 includes any hardware, software, firmware, or combination thereof for supporting communications between different types of networks. As a particular example, the communication interface unit 118 could represent CIU PRIME and CIU PLUS units from HONEYWELL ENRAF B.V. in The Netherlands.

A monitoring or management system 122 is coupled to the network 120. The management system 122 performs various operations related to the management of material(s) in the tanks 102*a*-102*c*. For example, the management system 122 could track the amount of material entering and leaving the tanks 102*a*-102*c*. The management system 122 includes any hardware, software, firmware, or combination thereof for managing one or more tanks. The management system 122 could, for example, include one or more processors 124 and one or more memories 126 for storing instructions and data used, generated, or collected by the processor(s) 124. The management system 122 could also include at least one network interface 128 for communicating over at least one network, such as one or more Ethernet or other interfaces. As a particular example, the management system 122 could implement or support the ENTIS PRO tank inventory system from HONEYWELL ENRAF B.V.

In this example, the management system 122 includes or supports a hatch monitoring tool 130. The hatch monitoring tool 130 monitors the material in a tank 102*a*-102*c* to determine if and when a hatch 114 of the tank is opened. The hatch monitoring tool 130 could then take suitable corrective action.

In some embodiments, the hatch monitoring tool 130 operates as follows. The level of material in a tank 102*a*-102*c* is monitored. When material is being added to the tank 102*a*-102*c*, the level of material in the tank 102*a*-102*c* can follow a relatively known pattern when the hatch 114 is closed. For example, the level of material in the tank 102*a*-102*c* may rise in a linear manner (assuming the flow of material into the tank 102*a*-102*c* remains constant). In contrast, if the hatch 114 of the tank 102*a*-102*c* is opened, the material in the tank 102*a*-102*c* may attain a relatively stable level when the material reaches the hatch 114. As a result, the hatch monitoring tool 130 can monitor the material level in the tank 102*a*-102*c* to detect when the hatch 114 is opened.

In other embodiments, the hatch monitoring tool 130 could monitor the rate of change in the material level in the tank 102*a*-102*c*. For example, the level of material in the tank 102*a*-102*c* can have a positive rate of change when the hatch 114 is closed and a much smaller rate of change (such as zero rate of change) when the hatch 114 is opened. As a result, the hatch monitoring tool 130 can monitor the rate of change in the material level in the tank 102*a*-102*c* to detect when the hatch 114 is opened.

Whatever the case, when the hatch monitoring tool 130 detects an open hatch 114, the tool 130 can take appropriate action. This may include notifying a user by raising an alarm, automatically closing the valve 106, or automatically turning off the pump 108. As noted below, the hatch monitoring tool 130 could also raise an alarm when it cannot be determined whether the hatch 114 is opened (such as when communications with the level sensor 112 are lost).

In this way, the hatch monitoring tool 130 can help to reduce the amount of material that is lost when a tank 102*a*-102*c* is being filled and its hatch 114 is opened. This can help to reduce monetary losses and environmental damage. Moreover, this approach represents a contactless solution, meaning no special sensors need to be physically installed on the hatch 114 itself. All that may be required is the level sensor 112, which is often already present in the tank. There may be no additional cabling or other installation requirements. If the level sensor 112 is not already present, a wired or wireless level sensor 112 could be installed and used to support this functionality (as well as other functions). In addition, the hatch monitoring functionality could be implemented automatically in the inventory management system 100. The tool 130 may be initiated and operate automatically without requiring a user to manually invoke this functionality.

The hatch monitoring tool 130 includes any hardware, software, firmware, or combination thereof for monitoring one or more tanks and detecting one or more open tank hatches. The hatch monitoring tool 130 could, for example, represent a software application. As a particular example, the tool 130 could be incorporated as a module into the ENTIS PRO tank inventory system from HONEYWELL ENRAF B.V.

Although FIG. 1 illustrates one example of an inventory management system 100, various changes may be made to FIG. 1. For example, a system could include any number of tanks, valves, pumps, sensors, actuators, networks, communication interfaces, and management systems. Also, the makeup and arrangement of the inventory management system 100 are for illustration only. Components could be added, omitted, combined, subdivided, or placed in any other suitable configuration according to particular needs. Further, each of the tanks 102*a*-102*c* could include any number of hatches 114, and one or multiple tools 130 could be used to monitor any number of hatches 114 on any number of tanks. In addition, FIG. 1 illustrates one operational environment in which the hatch monitoring functionality can be used. This functionality could be used in any other suitable device or system.

Figure 2:
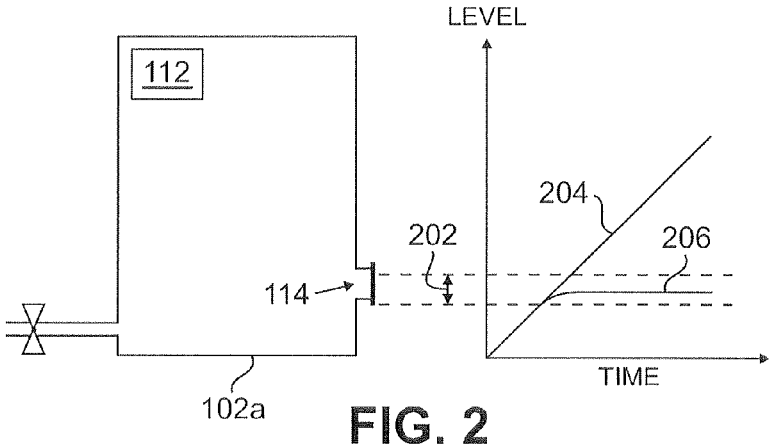
FIG. 2 illustrates an example monitoring of a tank hatch in an inventory management system according to this disclosure.

FIG. 2 illustrates an example monitoring of a tank hatch in an inventory management system according to this disclosure. The example monitoring shown in FIG. 2 is for illustration only. Other embodiments of the tank hatch monitoring could be used without departing from the scope of this disclosure.

In this example, the hatch monitoring tool 130 can be configured with the height of the bottom edge of the hatch 114 in the tank 102*a*. For example, this height could be expressed in terms of the material level at the bottom edge of the hatch 114 (as measured by the level sensor 112). This point represents the material level where a spill would begin to occur if the hatch 114 is open as the tank 102*a* is being filled.

Upper and lower bounds of a critical zone 202 can be defined relative to the height of the bottom edge of the hatch 114. In this example, the lower bound of the critical zone 202 is slightly below the bottom edge of the hatch 114, while the upper bound of the critical zone 202 is below the upper edge of the hatch 114. This is for illustration only. Any other suitable bounds can be used to define the critical zone 202. It may be noted that an accurate determination of the position of a hatch 114 can be made to help ensure that the critical zone 202 is as narrow as possible (which may help to avoid false alarms as described below). It may also be noted that repeated determinations of the position of a hatch 114 may be required since the tank 102*a* can settle over time (and possibly allow for spillage of material at a different material level).

The hatch monitoring tool 130 may operate by monitoring the material level in the tank 102*a* and comparing the material level with the critical zone 202. If the material level is below the lower bound of the critical zone 202, no spill may occur since the material in the tank 102*a* has not reached the hatch 114. In this case, the hatch monitoring tool 130 could be disarmed, meaning the hatch monitoring tool 130 performs no further actions and/or cannot raise an "open hatch" alarm. If the material level is above the upper bound of the critical zone 202, no spill may occur since the hatch 114 typically cannot be opened in this situation. Again, in this case, the hatch monitoring tool 130 could be disarmed. The hatch monitoring tool 130 could remain disarmed until the hatch monitoring tool 130 detects that the material level in the tank 102*a* has crossed the lower bound of the critical zone 202 in the rising direction. In this case, the material level is increasing and a spill could occur if the hatch 114 is opened.

When armed, the hatch monitoring tool 130 can analyze the measured material levels in the tank 102*a* and detect an open hatch. In some embodiments, the hatch monitoring tool 130 uses the actual material level in the tank 102*a* to detect an open hatch 114. For example, as shown in FIG. 2, two lines 204-206 represent the material level in the tank 102*a* when the hatch 114 is closed and opened, respectively. In these embodiments, the hatch monitoring tool 130 can determine whether the material level in the tank 102*a* stabilizes around a certain level within the critical zone 202 as shown by the line 206. If so, the hatch monitoring tool 130 can raise an open hatch alarm.

In other embodiments, the hatch monitoring tool 130 uses the rate of change in the material level in the tank 102*a* to detect an open hatch 114. For example, when the material level in the tank 102*a* crosses the lower bound of the critical zone 202 in the rising direction, the speed of the material level increase can be recorded. The speed could represent a change measured in meters per minute or any other suitable measurement. As shown in FIG. 2, the line 204 represents a relatively steady rate of increase over time, while the line 206 stabilizes and has little or no increase during later times. While the material level is in the critical zone 202, the hatch monitoring tool 130 can determine whether the measured rate of increase in the material level drops (such as by a specified percentage below the entrance speed) before the material level crosses the upper bound of the critical zone 202. If so, the hatch monitoring tool 130 can raise an open hatch alarm.

If and when the material level rises above the upper bound of the critical zone 202, the hatch monitoring tool 130 can be automatically disarmed. It is presumed here that the material level cannot rise above the upper bound of the critical zone 202 if the hatch 114 is open. Disarming the hatch monitoring tool 130 when the material rises above and below the critical zone 202 may be useful in avoiding false alarms, such as when a pump 108 is shut down. Of course, the hatch monitoring tool 130 need not be disarmed at these times, and other steps could be taken to avoid false alarms.

As noted above, multiple hatches 114 could be present on the tank 102*a*. In this case, the above-described functionality could be repeated for each of the hatches 114. In other words, a critical zone 202 can be defined for each hatch 114, and the hatch monitoring tool 130 could arm and disarm itself for each hatch 114 based on the material level in the tank 102*a*. Also, it may be noted that the height of the critical zone 202 can be configured for each hatch 114 and may depend, among other things, on the maximum capacity of a pump 108 feeding the tank 102*a* and the free gravitational flow rate of the material out of an open hatch 114.

Although FIG. 2 illustrates one example of the monitoring of a tank hatch in an inventory management system, various changes may be made to FIG. 2. For example, the critical zone 202 could have any other suitable size and location. In fact, although possibly not desired in some situations, the critical zone 202 could be defined as the upper and lower edges of the hatch 114. Also, the lines 204-206 shown in FIG. 2 are for illustration only. The material level in a tank 102*a* could have any other suitable values when the hatch 114 is opened and closed (and those values need not be linear).

FIGS. 3A through 6 illustrate an example user interface for monitoring a tank in an inventory management system according to this disclosure. The user interface components shown in FIGS. 3A through 6 are for illustration only. Other user interface components could also be used according to particular needs.

Figure 3A:
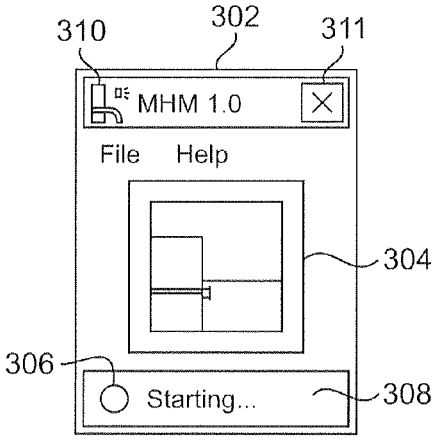

The hatch monitoring tool 130 could be initiated manually or automatically. For example, an icon or shortcut could be selected by a user (such as using a shortcut in the ENTIS PRO folder on a computing station implementing the management system 122). After the hatch monitoring tool 130 is initiated, a window 302 as shown in FIG. 3A can be presented to the user. This window 302 (as shown in FIGS. 3A through 3I) could remain "on top" of a user's display and may not be minimized or hidden, although in other embodiments at least some users (such as administrators) could minimize or hide the window 302.

In FIG. 3A, the window 302 includes an icon 304, an indicator 306, and a note 308. The icon 304 indicates the current status of the hatch monitoring tool 130. In FIG. 3A, the icon 304 is greyed out, indicating that no valid data connection has been established yet (such as when the hatch monitoring tool 130 has not established an OPC connection with the ENTIS PRO application). The indicator 306 indicates the status of a data connection or a data update. For example, the indicator 306 could turn orange when no data connection is established or when a data update is occurring. When a data connection has been established or when a data update has been completed successfully, the indicator 306 could turn green. The note 308 provides various data to the user, such as the status of the hatch monitoring tool 130 or the time of the last successful data update. An icon 310 may or may not appear in the window 302 depending on whether the hatch monitoring tool 130 is being executed by an administrator or an operator. An administrator may be able to modify the operation of the hatch monitoring tool 130 (such as by adjusting the critical zone 202 for a hatch 114), while operators may only be able to invoke and execute the hatch monitoring tool 130. Similarly, a close window button 311 may or may not appear in the window 302 depending on whether the hatch monitoring tool 130 is being executed by an administrator or an operator. An administrator may be able to close the window 302, while an operator may be unable to close the window 302.

Figure 3B:
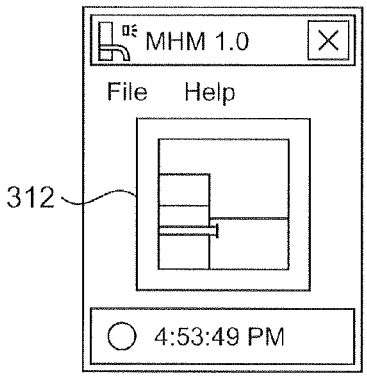
Figure 3C:
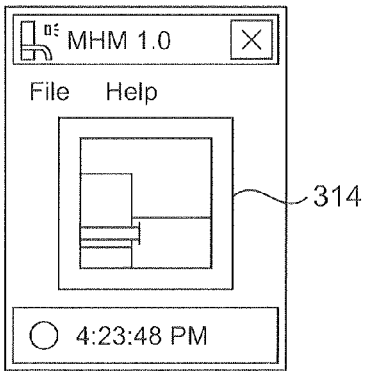
Figure 3D:
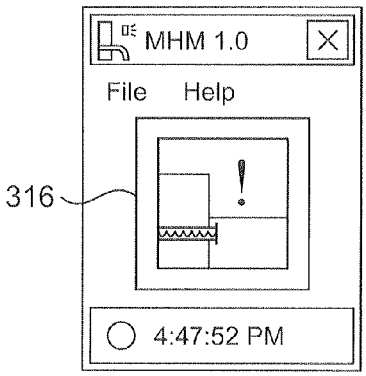

FIGS. 3B through 3D illustrate how the icon in the window 302 changes as the level of material in at least one tank 102*a*-102*c* changes. In FIG. 3B, the window 302 includes an icon 312 indicating that the level of material in a tank 102*a*-102*c* is above the critical zone 202. In FIG. 3C, the window 302 includes an icon 314 indicating that the level of material in a tank 102*a*-102*c* is below the critical zone 202. In FIG. 3D, the window 302 includes an icon 316 indicating that the level of material in a tank 102*a*-102*c* is within the critical zone 202. In all three cases, the hatch monitoring tool 130 has not initiated any alarms. In FIGS. 3B and 3C, the hatch monitoring tool 130 could be disarmed, so it would not be attempting to identify any open hatches. In FIG. 3D, the material level in a tank 102*a*-102*c* is within the critical zone, so the hatch monitoring tool 130 is monitoring the material level to identify an open hatch (note that a pump shutdown or other disturbance here could trigger a false alarm).

During operation, the hatch monitoring tool 130 could generate various alarms, which lead to modifications of the icon shown in the window 302. For example, an open hatch alarm can be triggered when the hatch monitoring tool 130 determines that a hatch 114 in a tank 102*a*-102*c* has been left open and the material level is rising in the tank 102*a*-102*c*. If a reliable material level in a tank 102*a*-102*c* cannot be obtained (such as due to failure of the level sensor 112), the hatch monitoring tool 130 could raise a data alarm. In this case, the hatch monitoring tool 130 cannot determine the state of a hatch since it lacks reliable data. If the hatch monitoring tool 130 loses a data connection (such as an OPC connection to the ENTIS PRO application), the hatch monitoring tool 130 cannot receive any data and triggers a communication alarm. The communication alarm may continue until the data connection is restored, and other alarms might not be triggered while the communication alarm is active. In addition, a test alarm can be used to test the hatch monitoring tool 130.

Figure 3E:
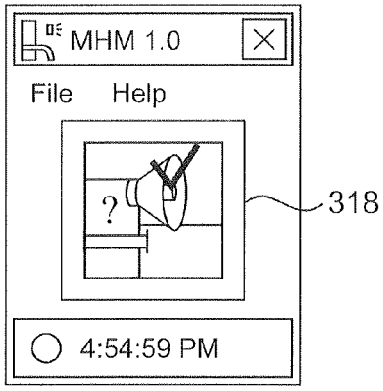
Figure 3F:
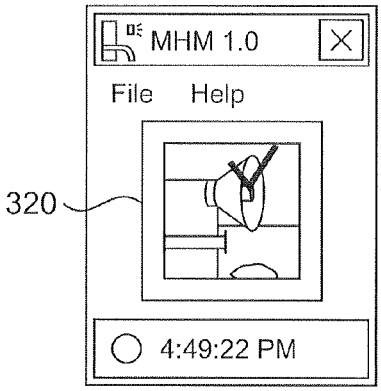
Figure 3G:
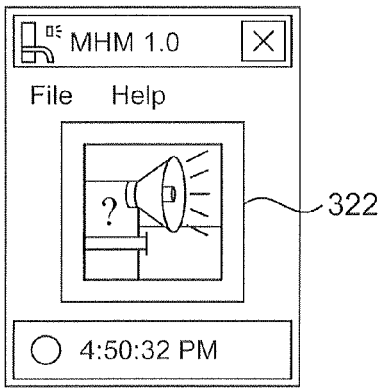
Figure 3H:
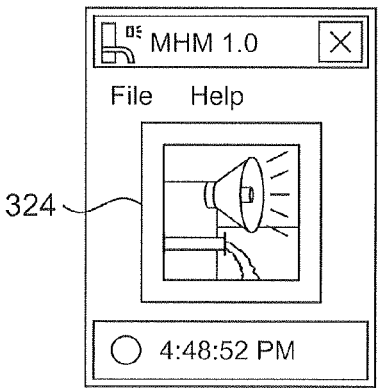

FIGS. 3E through 3H illustrate how the icon in the window 302 changes based on one or more alarms and whether an alarm has been acknowledged. In FIG. 3E, the window 302 includes an icon 318, which includes a speaker symbol, a question mark, and a check mark. The speaker symbol indicates that an alarm has been issued, and the question mark indicates that the alarm is a data fail or communication alarm (so the hatch monitoring tool 130 cannot determine the level of material in a tank 102*a*-102*c*). The check mark indicates that the alarm has been acknowledged by a user. In FIG. 3F, an icon 320 includes a speaker symbol, an image of material on the ground near a tank, and a check mark. This icon indicates that an open hatch alarm has been raised and acknowledged by the user. In FIG. 3G, an icon 322 includes a speaker symbol and a question mark (but no check mark), indicating an unacknowledged data fail or communication alarm. In FIG. 3H, an icon 324 includes a speaker symbol and an image of material escaping a tank (but no check mark), indicating an unacknowledged open hatch alarm.

It may be noted that the window 302 can be used to denote the status of multiple hatches. In this case, the icon displayed in the window 302 represents the icon with the highest priority. For example, the icons could have an increasing priority as shown in FIGS. 3B through 3H (where the icon 312 in FIG. 3B has the lowest priority and the icon 324 shown in FIG. 3H has the highest priority). The hatch monitoring tool 130 could identify the icon for each monitored hatch and select the icon with the highest priority for display.

Figure 3I:
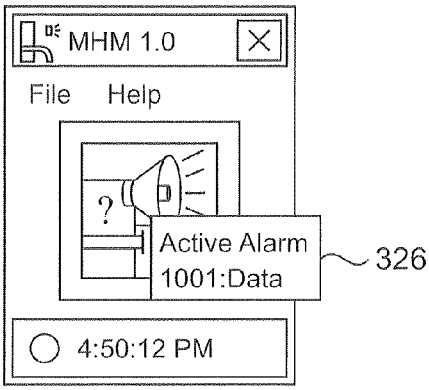

It may also be noted that "tool tips" or pop-up boxes can be provided to a user if the user places a cursor over an icon in the window 302. An example of this is shown in FIG. 3I, where a text box 326 appears over the icon in the window 302 and provides various information (depending on the icon). If used with the icon 314 in FIG. 3C, the text box 326 could provide the names of any "dry" hatches 114 (where the material level is lower than the hatches 114). If used with the icon 316 in FIG. 3D, the text box 326 could provide the names of any hatches 114 where the material level is in the critical zone. If used with the icon 318 in FIG. 3E or the icon 322 in FIG. 3G, the text box 326 could provide the names of any hatches for which a state could not be determined (due to unavailable data). If used with the icon 320 in FIG. 3F or the icon 324 in FIG. 3H, the text box 326 could provide the names of any hatches that are or were detected as being open.

Figure 4:
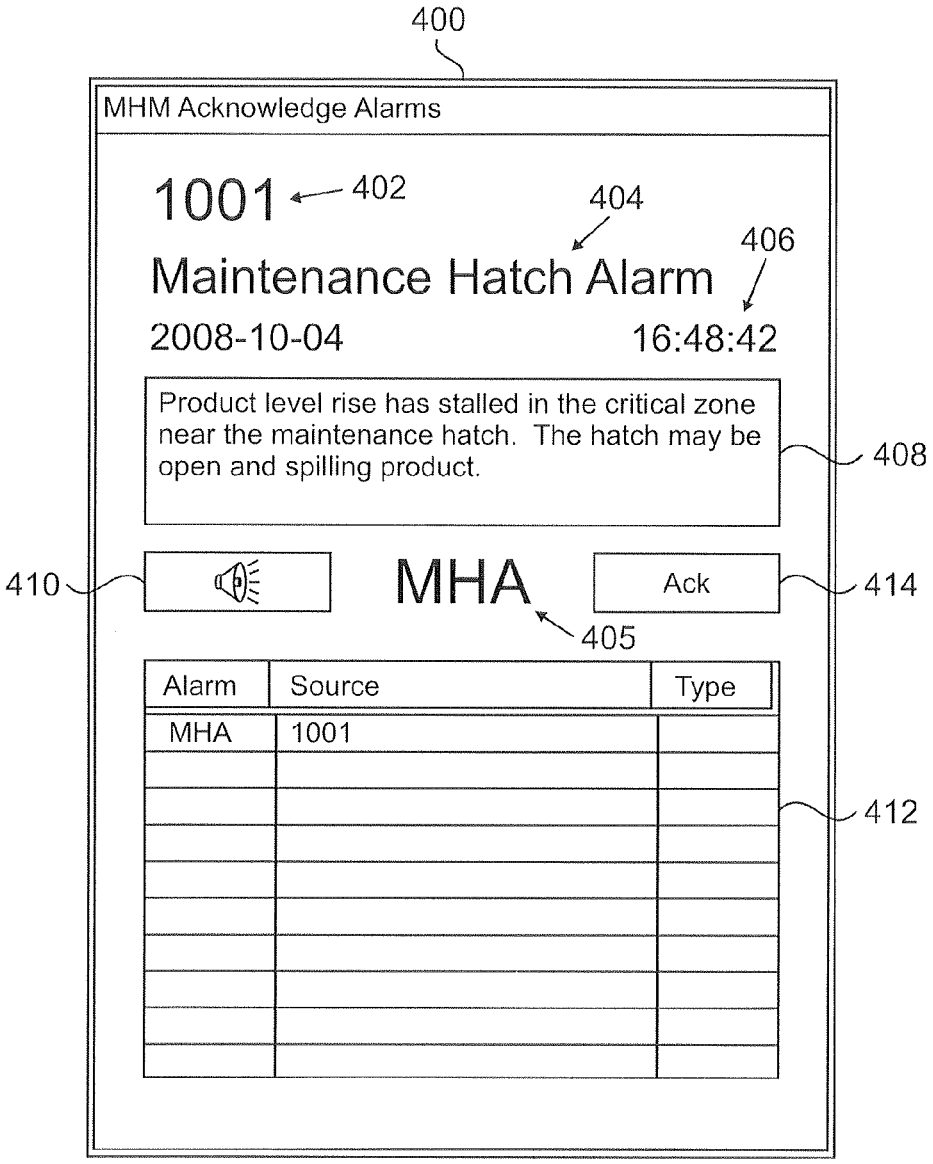

When a new alarm is generated by the hatch monitoring tool 130, a window 400 as shown in FIG. 4 could also be displayed to a user. The window 400 includes a name 402 identifying a particular hatch 114 associated with the new alarm (and which could be specified in a configuration file or in another manner). The window 400 also includes a type 404 and abbreviation 405 identifying the type of alarm. The type 404 and abbreviation 405 could, for example, indicate that the alarm is a maintenance hatch alarm (MHA) (a hatch 114 is opened), a data fail alarm (DAL), a communication alarm (CAL), or a test alarm (TST). A timestamp 406 identifies the date and time the alarm was activated. A text box 408 provides a textual description of the alarm. A button 410 can be selected by the user to mute the alarm (the alarm may be associated with an audible indicator). The alarm sound may remain muted until the user selects the button 410 again or a new alarm is issued. A list 412 identifies all active (unacknowledged) alarms that have been raised by the hatch monitoring tool 130. The user can select an alarm contained in the list 412, view information about that alarm in the window 400, and use a button 414 to acknowledge the selected alarm. Note that shortcuts (such as holding down the "a" key while selecting an alarm in the list 412) could be used to acknowledge alarms. Also note that multiple alarms can be selected in the list 412 (such as using the "Shift" or "Ctrl" key to select multiple alarms) and acknowledged simultaneously.

Figure 5:
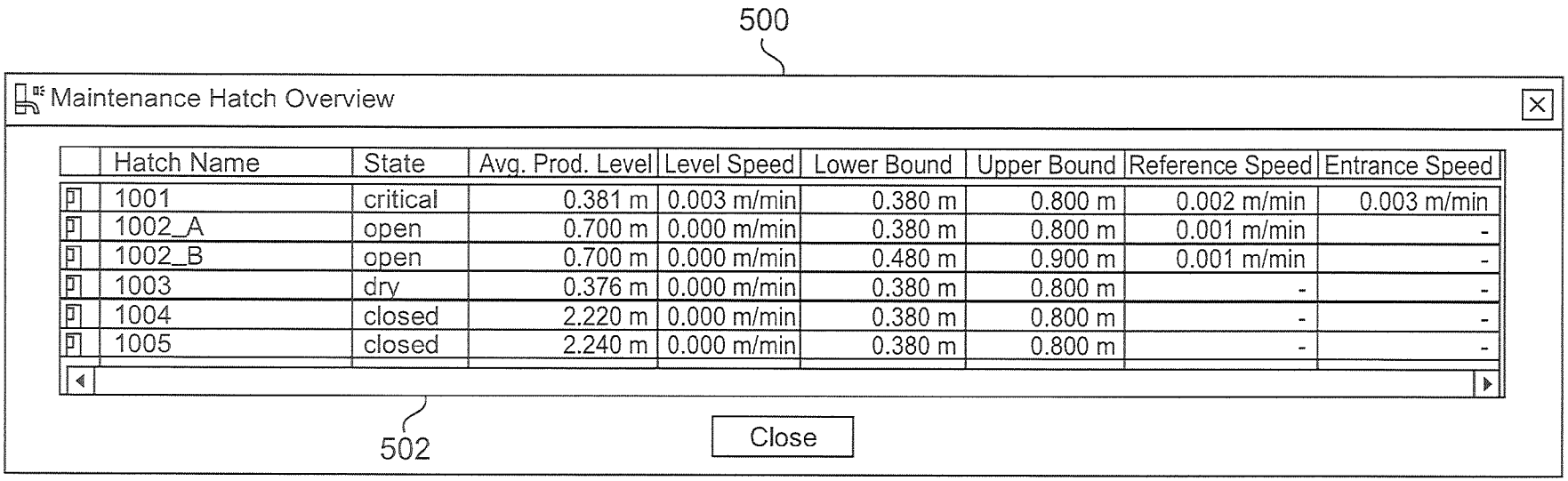

If the icon in the window 302 is selected by a user (such as using a mouse), an overview window 500 as shown in FIG. 5 can be presented to the user. The overview window 500 includes a table 502 showing the status of each hatch 114 being monitored by the hatch monitoring tool 130. Each row of the table 502 contains information about a different hatch. Here, each row includes an icon (such as one of the icons in FIGS. 3B-3H) indicating the alarm state for a hatch and a name of that hatch.

Each row also includes a hatch state. In some embodiments, the hatch state could have one of the following values:

- unknown: There is insufficient data available about the material level in a tank due to a data fail alarm, a communication alarm, or insufficient sample points to determine the speed of the material.
- dry: The material level is below the hatch, so the hatch is dry and can be opened.
- critical: The material level is in the critical zone of the hatch.
- pending(x): An alarm is being postponed for a specified number of data updates to be sure that the alarm condition remains before notifying a user. The value of (x) represents the remaining number of updates before the hatch's state is changed to open. This can be used to reduce false alarms, although it postpones the raising of an alarm when a hatch is actually open.
- open: The material level is not rising or is rising too slow, and an alarm has been activated.
- closed: The material level is above the critical zone.

Each row in the table 502 further includes information associated with the material level in a tank associated with the hatch. An average product level represents the average material level in the tank for a specified period of time. The use of an average material level can help to avoid false alarms caused by turbulence in a tank, which can occur during filling or at other times. A level speed identifies the speed at which the material level is changing (such as the change in average level per minute). The level speed may require a specified amount of data (such as at least 10% of the averaging period). Lower and upper bound values define the critical zone for a hatch 114. A reference speed represents the expected or desired minimum change in material level during filling. The reference speed is compared to the level speed to determine if an open hatch alarm should be triggered. An entrance speed represents the speed of the material level increase when the lower bound of the critical zone is crossed in the rising direction. It may be noted that the reference speed could equal a specified percentage of the entrance speed or a minimum speed (whichever is greater). Also note that the reference speed can be set to a larger percentage of the entrance speed when the hatch's state changes to open or pending, creating hysteresis to avoid quick alarm toggles.

Although not shown in FIG. 5, various other fields could be presented in the table 502. For example, each row could include the minimum speed specified for a hatch, which can be used when the hatch's entrance speed is too low or is not available. Each row could also include a speed drop allowed value, which specifies the percentage used to calculate the reference speed from the entrance speed (such as when the reference speed is 80% of the entrance speed). Each row could further include a resume speed, which represents a specified percentage used to calculate a new reference speed from the entrance speed after an open hatch is (possibly) detected. This value determines the level speed that needs to be obtained in order to deactivate an open hatch alarm, such as 90% of the entrance speed. In addition, while not shown, color coding or other indicators could be used to denote different criticalities of hatch states. For instance, hatches with pending or issued alarms (hatches in the open, unknown, or pending state) could be highlighted in red. Hatches in the critical state could be highlighted in orange, and hatches in the closed or dry state could be highlighted in green.

The hatch monitoring tool 130 can also generate a number of events that are stored in an event file. The event file can be opened by a viewer application and viewed in an event window 600 as shown in FIG. 6. The event window 600 in FIG. 6 includes a table 602 with rows containing various information about events. For example, each row includes a unique event number for an event, a timestamp for the event, the station associated with the event, and the username of the user associated with the event. Each row also includes a task name identifying the source of the event (in this case, MHM for Maintenance Hatch Monitor). Multiple applications could store events in the event file, so the task name can help to identify events associated with the hatch monitoring tool 130. Each row further includes an event type identifying a type of event. The event type could include the starting or stopping of the hatch monitoring tool 130, a state change for a hatch (depending on material level in a tank), activation of an alarm, acknowledgement of an alarm, and inactivation of an alarm. In addition, each row identifies a source of an event (such as a hatch, an application, or a user) and a description of the event.

In some embodiments, various values used by the hatch monitoring tool 130 are defined in a configuration file, such as an XML file. The configuration file could define various parameters used to determine if and when an open hatch alarm is initiated. The hatch monitoring tool 130 could access the configuration file and identify the relevant parameters when it is initiated or at other suitable times. The values in Table 1 represent some example parameters that could be defined in a configuration file.

TABLE 1

| XML Tag Name | Description |
|---|---|
| MeasurementsIntervalSeconds | The interval at which the hatch monitoring tool 130 updates measurement data (such as from the level sensors 112). Setting this to a value less than the update rate of data from the instruments may cause extra CPU load without becoming more accurate. Minimum value could be five seconds. |
| MHADelayCycles | The number of measurement update cycles that an open hatch alarm needs to sustain before the open hatch alarm is raised to attract a user's attention. Some situations (such as hot standby switchovers, daylight savings time changes, or application startup in critical zones) can temporarily reduce the accuracy of level speed measurements and possibly cause false open hatch alarms. To prevent users from becoming insensitive to open hatch alarms, the MHADelayCycles option can be used to suppress short (false) open hatch alarms. The value of (MHADelayCycles* MeasurementsIntervalSeconds) might not exceed fifteen minutes to prevent excessive material spills for true open hatch alarms. Default value could be zero. |
| AverageOverSeconds | The period over which measurement data is averaged before comparison. This can be used to dampen material level movement due to turbulence. It may not be less than the MeasurementsIntervalSeconds value. |
| DataFailDelaySeconds | The length of time that measurement data is allowed to be of insufficient quality before a data fail alarm is raised. After a data fail alarm has been raised, good quality data may be needed for the same period before the data fail alarm is reset. This value may not be more than AverageOverSeconds. |
| MinimumLevelSpeed | The minimum speed at which the material level in a tank should rise (such as per minute) to avoid an open hatch alarm. This may depend on the tank diameter/size and a pump's capacity and characteristics. When level is measured in meters, the MinimumLevelSpeed can be expressed in meters per minute. This tag may (re)appear at the tank and/or hatch level to overrule the value defined at the more global level (such as a global MinimumLevelSpeed of 1 mm/min, which can be overruled with a more appropriate value for a specific tank). |
| SpeedDropAllowed | A factor defining how much the measured level speed is allowed to drop below the entrance speed before an open hatch alarm is raised (for example, if 0.8, an alarm is raised when the measured level speed drops below 80% of the recorded entrance speed). This tag may (re)appear at the tank and/or hatch level to overrule the value defined at the more global level. |
| SpeedResumed | A factor that establishes a certain hysteresis for the open hatch alarm. If an alarm was activated because the measured level speed dropped too low, the level speed should rise to the entrance speed multiplied by this factor to inactivate the alarm (for example, if 0.9, an open hatch alarm is inactivated when the level speed reaches 90% of the entrance speed). This tag may (re)appear at the tank and/or hatch level to overrule the value defined at the more global level. |
| NumberFormat | The format used to write data in an event/log file. These formats could comply with those provided in the MICROSOFT .NET Framework Developer's Guide. A decimal separator can be used to match the regional settings in MICROSOFT WINDOWS. |

TABLE 1-continued

| XML Tag Name | Description |
|---|---|
| Station/Name<br>Station /URL | A definition of a data connection to a station providing data (such as an OPC connection to an ENTIS PRO station running an OPC server). The node name may be expressed as 'localhost', IP-number, Netbios name or DNS name. |
| Tanks | A collection of tanks having hatches to be monitored. |
| Tank TankID="..."<br>levelGaugeType="..." | A "Tank" defines one tank, and the "TankID" attribute is the name of the tank. The "levelGaugeType" attribute identifies the type of level sensor 112 used in the tank, such as "servo" or "radar." This gauge attribute can be used to distinguish instruments capable of gauge commands when hatch monitoring is not possible. |
| MaintenanceHatches | A collection of hatches in a tank. A tank can have one or more hatches. |
| MaintenanceHatch<br>HatchID="..." | Defines one hatch. The "HatchID" attribute is the name of the hatch (which is shown in alarm dialogs and event messages). For more than one hatch in a tank, the HatchIDs may have a format to give them unique names, such as "@_North" and "@_South." The "@" character in the HatchID can be replaced by the TankID of the tank associated with the hatch, such as "1001_North" and "1001_South." |
| Logging | When "enabled," a log file is created with all measurement data evaluated for a particular batch. Can be used for diagnostic and tuning purposes. Should be used with care to avoid disk space flooding. |
| ReferenceLevel | The level of the lower inner edge of a hatch expressed as Product Level (the level of material as measured to reach the lower inner edge of the hatch). This is the level at which a spill starts when a hatch has been left open. For example, when a ProductLevel parameter in a tank is measured from a datum plate 50 mm above the foot of the tank and the hatch is 400 mm above the foot of the tank, the ReferenceLevel can be set to 350 mm because this is the measured level when the product reaches the lower inner edge of the hatch. This value should be as accurate as possible because it is the reference point of the critical zone at which a sudden decline in material level speed would be identified when the hatch is opened. This can be expressed in the same dimension as the ProductLevel, and the same decimal separator as defined in the WINDOWS regional options can be used. |
| LowerBound | The lower end of the critical zone in which the level speed is monitored. It can be set relative to the ReferenceLevel and be a negative number (where ReferenceLevel+ LowerBound > 0). The same decimal separator as defined in the WINDOWS regional options can be used. |
| UpperBound | The upper end of the critical zone in which the level speed is monitored. It can be set relative to the ReferenceLevel and be a positive number. Above this level, a decline or stop of level speed does not create an open hatch alarm. The same decimal separator as defined in the WINDOWS regional options can be used. |

Many of the parameters in Table 1 appear in the table 502 shown in FIG. 5. Some of the contents of the table 502 could be based on the information in the configuration file. If appropriate (such as when an administrator is viewing the window 500), the user could make changes to values in the table 502, which could then be used to update the configuration file. Of course, changes to the configuration file can also be reflected in the table 502.

Although FIGS. 3A through 6 illustrate one example of a user interface for monitoring a tank hatch in an inventory management system, various changes may be made to FIGS. 3A through 6. For example, other user interfaces could be used to provide the same information or different information to a user regarding the operation of the hatch monitoring tool 130. Also, the user interface in each figure could contain any other or additional information in any suitable arrangement.

In addition, information about any suitable number of tanks and tank hatches could be presented using the user interface shown here.

Figure 7:
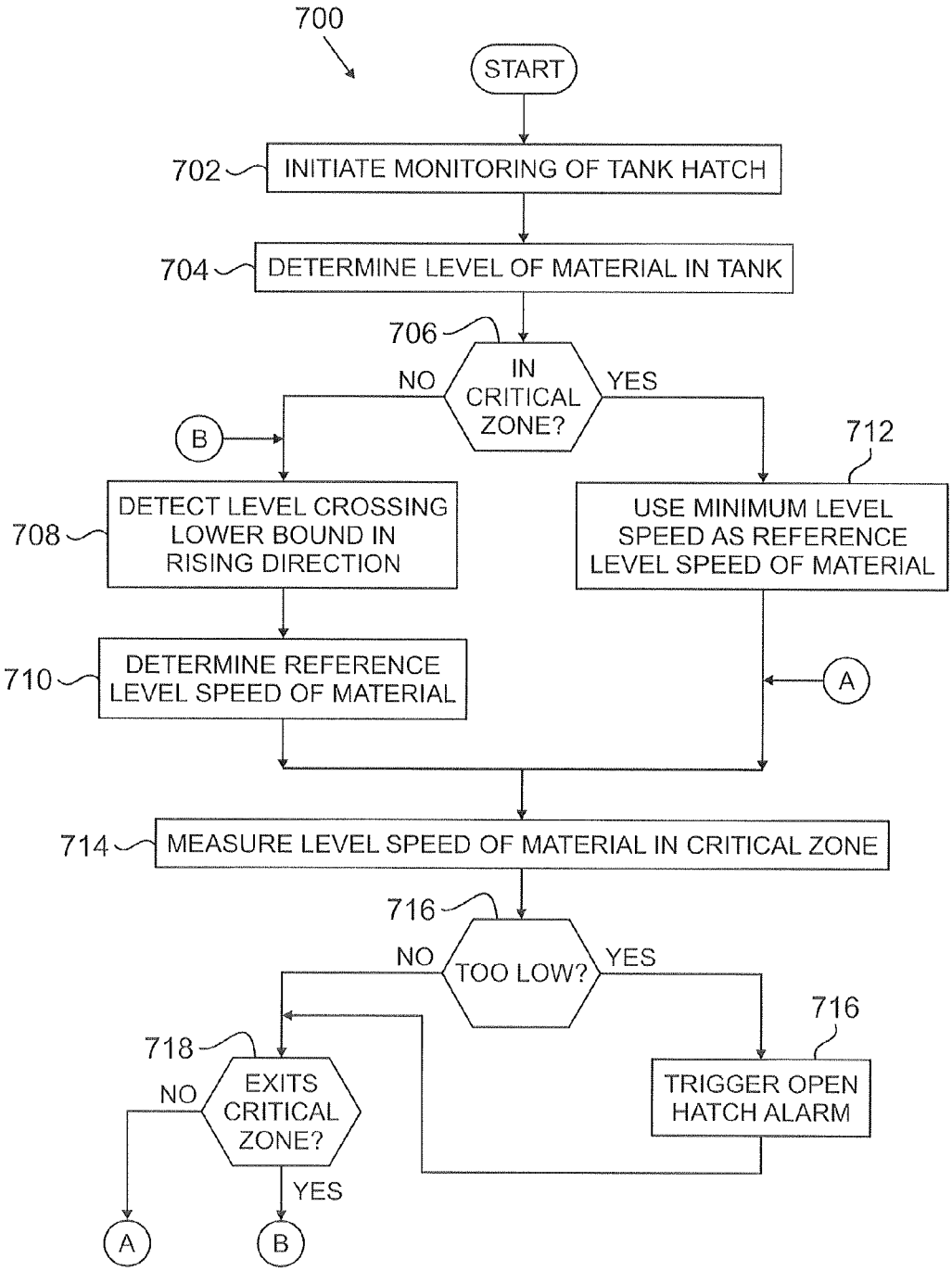
FIG. 7 illustrates an example method for monitoring a tank hatch in an inventory management system according to this disclosure.

FIG. 7 illustrates an example method 700 for monitoring a tank hatch in an inventory management system according to this disclosure. The embodiment of the method 700 shown in FIG. 7 is for illustration only. Other embodiments of the method 700 could be used without departing from the scope of this disclosure.

Monitoring of a tank hatch is initiated at step 702. This could include, for example, initiating execution of the hatch monitoring tool 130. The hatch monitoring tool 130 could be invoked manually or automatically, such as automatically when an operator logs onto an operation station. At this point, the level of material in a tank associated with the hatch may not be known, and the level of material in the tank is determined at step 704. This could include, for example, the hatch monitoring tool 130 receiving measurement data from a level sensor 112 associated with the tank.

A determination is made whether the material in the tank is already within a critical zone for the hatch at step 706. This could include, for example, the hatch monitoring tool 130 comparing the determined level of material in the tank with the upper and lower bounds of the critical zone 202 for that hatch.

If not in the critical zone, the tool waits to detect the level of material in the tank crossing the lower bound of the critical zone in the rising direction at step 708. During this step, the hatch monitoring tool 130 could be disarmed during specified time periods (such as when the material level in the tank is above the upper bound of the critical zone 202). Once disarmed, the hatch monitoring tool 130 waits to detect the material level increasing above the lower bound of the critical zone. When that occurs, a reference level speed for the material is determined at step 710. This could include, for example, the hatch monitoring tool 130 using measurements from the level sensor 112 to determine the entrance speed (the rate at which the material level in the tank is increasing when the material level crosses the lower bound of the critical zone 202). This may also include the hatch monitoring tool 130 multiplying the entrance speed by a specified factor (such as 80%) to identify the reference level speed.

If the material in the tank is already within the critical zone at step 706, the hatch monitoring tool 130 cannot measure the entrance speed of the material in the tank as it crosses the lower bound of the critical zone 202. In this case, a minimum level speed of the material is used as the reference level speed at step 712. This could include, for example, the hatch monitoring tool 130 identifying the minimum level speed specified for the tank or for the hatch.

In either case, once the material level is in the critical zone, the level speed of the material is measured at step 714. This could include, for example, the hatch monitoring tool 130 receiving additional measurements from the level sensor 112. A determination is made whether the measured level speed is too low at step 716. This could include, for example, determining if the measured level speed has fallen below the reference level speed. If so, this is indicative of an open hatch in the tank, and an open hatch alarm is triggered at step 716. This could include, for example, presenting a display to the user identifying the hatch and the problem with the hatch (in this case, the hatch may be open). Of course, other or additional actions could be taken here, such as shutting off a pump feeding material to the tank or closing a valve through which material enters the tank.

A determination is made whether the material in the tank exits the critical zone at step 718. If not, the method 700 returns to step 714 to continue monitoring the material level in the tank. If so, the method 700 returns to step 708 to await the material level crossing the lower bound of the critical zone in the rising direction again.

Although FIG. 7 illustrates one example of a method 700 for monitoring a tank hatch in an inventory management system, various changes may be made to FIG. 7. For example, the hatch monitoring tool 130 need not disarm itself when the material level in a tank is outside of the critical zone. Also, while shown as using the speed or rate of change in the material level in the tank, the hatch monitoring tool 130 could use absolute level measurements to detect an open hatch (such as by detecting when the material level in a tank does not increase beyond a certain point). In addition, while shown as a series of steps, various steps in FIG. 7 could overlap, occur in parallel, occur in a different order, or occur multiple times. As a particular example, various steps in FIG. 7 (such as steps 704-718) could be repeated for each of multiple hatches being monitored.

In some embodiments, various functions described above are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory.

It may be advantageous to set forth definitions of certain words and phrases used throughout this patent document. The term "couple" and its derivatives refer to any direct or indirect communication between two or more elements, whether or not those elements are in physical contact with one another. The terms "application" and "program" refer to one or more computer programs, software components, sets of instructions, procedures, functions, objects, classes, instances, related data, or a portion thereof adapted for implementation in a suitable computer code (including source code, object code, or executable code). The terms "transmit," "receive," and "communicate," as well as derivatives thereof, encompass both direct and indirect communication. The terms "include" and "comprise," as well as derivatives thereof, mean inclusion without limitation. The term "obtain" and its derivatives refer to any acquisition of data or other item, whether acquired from an external source or internally (such as through internal generation of the data or other item). The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, software, or some combination of at least two of the same. The functionality associated with any particular controller may be centralized or distributed, whether locally or remotely.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method comprising:

receiving information associated with a level of material in a tank, the tank having a hatch providing access to an interior of the tank;

determining whether the level of material in the tank experiences a specified variation within a critical zone associated with the hatch, the specified variation indicative of the hatch being open while the tank is being filled, the critical zone defined by a lower bound associated with a lower edge of the hatch and an upper bound associated with an upper edge of the hatch; and generating an alarm when the level of material in the tank experiences the specified variation.

2. The method of claim 1, wherein determining whether the level of material in the tank experiences the specified variation comprises:

measuring an entrance level speed of the material, the entrance level speed comprising a rate at which the level of material in the tank is increasing when the material level crosses the lower bound of the critical zone;

determining a reference level speed using the entrance level speed; and determining whether a measured level speed of the material in the tank falls below the reference level speed when the material level is in the critical zone.

3. The method of claim 2, wherein determining whether the level of material in the tank experiences the specified variation further comprises:

using a minimum level speed of the material as the reference level speed when the entrance level speed cannot be determined.

4. A method comprising:

receiving information associated with a level of material in a tank, the tank having a hatch;

determining whether the level of material in the tank experiences a specified variation within a critical zone associated with the hatch, the specified variation indicative of the hatch being open while the tank is being filled; and generating an alarm when the level of material in the tank experiences the specified variation;

wherein determining whether the level of material in the tank experiences the specified variation comprises:

measuring an entrance level speed of the material, the entrance level speed comprising a rate at which the level of material in the tank is increasing when the material level crosses a lower bound of the critical zone;

determining a reference level speed using the entrance level speed; and determining whether a measured level speed of the material in the tank falls below the reference level speed when the material level is in the critical zone; and wherein the method further comprises:

determining a resume level speed using the entrance level speed; and inactivating the alarm when the measured level speed of the material in the tank rises above the resume level speed.

5. The method of claim 4, wherein:

the reference level speed comprises a first percentage of the entrance level speed; and the resume level speed comprises a second larger percentage of the entrance level speed.

6. The method of claim 1, further comprising:

not generating the alarm when the level of material in the tank is outside of the critical zone.

7. The method of claim 1, wherein receiving the information comprises receiving level measurement data from a sensor associated with the tank.

8. The method of claim 7, wherein:

the level measurement data is received during a sequence of data update cycles; and generating the alarm comprises generating the alarm if the specified variation is maintained over multiple consecutive data update cycles.

9. A method comprising:

receiving information associated with a level of material in a tank, the tank having a hatch;

determining whether the level of material in the tank experiences a specified variation within a critical zone associated with the hatch, the specified variation indicative of the hatch being open while the tank is being filled; and generating an alarm when the level of material in the tank experiences the specified variation;

wherein the critical zone is defined by two offset values associated with a bottom edge of the hatch.

10. An apparatus comprising:

at least one interface configured to receive information associated with a level of material in a tank, the tank having a hatch configured to provide access to an interior of the tank; and at least one processor configured to:

determine whether the level of material in the tank experiences a specified variation within a critical zone associated with the hatch, the specified variation indicative of the hatch being open while the tank is being filled, the critical zone defined by a lower bound associated with a lower edge of the hatch and an upper bound associated with an upper edge of the hatch; and output an alarm when the level of material in the tank experiences the specified variation.

11. The apparatus of claim 10, wherein the at least one processor is configured to determine whether the level of material in the tank experiences the specified variation by:

determining an entrance level speed of the material, the entrance level speed comprising a rate at which the level of material in the tank is increasing when the material level crosses the lower bound of the critical zone;

determining a reference level speed using the entrance level speed; and determining whether a measured level speed of the material in the tank falls below the reference level speed when the material level is in the critical zone.

12. The apparatus of claim 11, wherein the at least one processor is configured to determine whether the level of material in the tank experiences the specified variation further by:

using a minimum level speed of the material as the reference level speed when the entrance level speed cannot be determined.

13. The apparatus of claim 10, wherein the at least one processor is further configured to not generate the alarm when the level of material in the tank is outside of the critical zone.

14. The apparatus of claim 10, wherein the at least one processor is configured to output the alarm by generating a graphical display for a user, the graphical display comprising information associated with the alarm.

15. The apparatus of claim 14, wherein:

the at least one processor is configured to monitor multiple tanks and generate alarms associated with multiple hatches; and the graphical display comprises information associated with multiple alarms.

16. An apparatus comprising:

at least one interface configured to receive information associated with a level of material in a tank, the tank having a hatch; and at least one processor configured to:

determine whether the level of material in the tank experiences a specified variation within a critical zone associated with the hatch, the specified variation indicative of the hatch being open while the tank is being filled; and output an alarm when the level of material in the tank experiences the specified variation;

wherein the critical zone is defined by two offset values associated with a bottom edge of the hatch.

17. A system comprising:

a sensor configured to measure a level of material in a tank, the tank having a hatch configured to provide access to an interior of the tank; and a monitor configured to:

receive from the sensor measurement data associated with the level of material in the tank;

determine whether the level of material in the tank experiences a specified variation within a critical zone associated with the hatch, the specified variation indicative of the hatch being open while the tank is being filled, the critical zone defined by a lower bound associated with a lower edge of the hatch and an upper bound associated with an upper edge of the hatch; and generate an alarm when the level of material in the tank experiences the specified variation.

18. The system of claim 17, wherein the monitor is configured to determine whether the level of material in the tank experiences the specified variation by:

determining an entrance level speed of the material, the entrance level speed comprising a rate at which the level of material in the tank is increasing when the material level crosses the lower bound of the critical zone;

determining a reference level speed using the entrance level speed; and determining whether a measured level speed of the material in the tank falls below the reference level speed when the material level is in the critical zone.

19. The system of claim 18, wherein the monitor is configured to determine whether the level of material in the tank experiences the specified variation further by:

using a minimum level speed of the material as the reference level speed when the entrance level speed cannot be determined.

20. A non-transitory tangible computer readable storage medium embodying a computer program, the computer program comprising:

computer readable program code for determining whether a level of material in a tank experiences a specified variation within a critical zone associated with a hatch of the tank, the specified variation indicative of the hatch being open while the tank is being filled, the critical zone defined by a lower bound associated with a lower edge of the hatch and an upper bound associated with an upper edge of the hatch; and computer readable program code for initiating an alarm when the level of material in the tank experiences the specified variation.

21. The method of claim 1, wherein:

the lower bound of the critical zone is below the lower edge of the hatch; and the upper bound of the critical zone is below the upper edge of the hatch and above the lower edge of the hatch.

* * * * *